United States Patent [19]
Horowitz et al.
[11] 4,297,108
[45] Oct. 27, 1981

[54] DESULFURIZATION OF COAL

[75] Inventors: Carl Horowitz; Michael Dichter, both of Brooklyn, N.Y.

[73] Assignee: Polymer Research Corp. of America, Brooklyn, N.Y.

[21] Appl. No.: 142,828

[22] Filed: Apr. 22, 1980

Related U.S. Application Data

[63] Continuation-in-part of Ser. No. 904,505, May 10, 1978, abandoned.

[51] Int. Cl.³ ..... C10L 9/02
[52] U.S. Cl. ..... 44/1 SR; 201/17; 209/9; 209/10
[58] Field of Search ..... 209/166, 167, 1, 2, 209/9, 10, 12; 201/17; 423/61; 44/1 R, 1 SR

[56] References Cited

U.S. PATENT DOCUMENTS

| | | | |
|---|---|---|---|
| 1,329,493 | 2/1920 | Baron | 209/167 X |
| 1,552,197 | 9/1925 | Bates | 209/166 |
| 2,319,394 | 5/1943 | Erickson | 209/166 X |
| 3,909,211 | 9/1975 | Diaz | 423/461 X |
| 3,926,575 | 12/1975 | Meyers | 44/1 SR X |
| 3,957,958 | 5/1976 | Katz | 423/461 |
| 4,025,588 | 5/1977 | Dessau | 44/112 |
| 4,083,940 | 4/1978 | Das | 423/461 |
| 4,134,737 | 1/1979 | Yang | 44/1 SR X |
| 4,158,548 | 6/1979 | Burk | 44/1 R |

FOREIGN PATENT DOCUMENTS

| | | | |
|---|---|---|---|
| 1800070 | 5/1970 | Fed. Rep. of Germany | 201/17 |
| 536713 | 5/1941 | United Kingdom | 201/17 |

*Primary Examiner*—Robert Halper
*Attorney, Agent, or Firm*—Steinberg & Raskin

[57] ABSTRACT

Pyritic sulfur, organic sulfur and elemental sulfur are removed from coal by subjecting an aqueous slurry of coal to flotation for removal of most of the pyritic sulfur after which the coal obtained from the flotation is treated with dilute nitric acid which oxidizes any remaining pyritic sulfur and most of the organic sulfur, thus solubilizing the sulfur and reducing the sulfur content thereof. This coal can be filtered, washed and dried, if desired. Further reduction of organic sulfur is obtained by chemical treatment with unsaturated hydrocarbons which bind the organic sulfur thus lowering the sulfur content of the coal sufficiently so that the final product meets all requirements for use for power plants as well as for the metallurgical industry.

10 Claims, No Drawings

DESULFURIZATION OF COAL

CROSS REFERENCE TO RELATED APPLICATION

This application is a continuation in part of our copending application Ser. No. 904,505, filed May 10, 1978, now abandoned for "Method of Removing Sulfur from Coal".

BACKGROUND OF THE INVENTION

An increased demand of fuel for power plants and for other types of industries, particularly in view of the high cost of oil, as well as the short supply of fuel oil, has created a situation in which coal has become most valuable and cheapest fuel available. An important factor which influenced the change from coal to oil and gas in previous years has been the cleaner burning of the oil and gas which reduced the emission of pollutants to the atmosphere.

Among the most damaging of the air pollutants are the sulfur oxides resulting from the burning of sulfur-containing fuels. Natural ambient air quality standards and emission standards can generally be met in the case of the burning of coal only if the coal contains less than 1% of sulfur.

The sulfur in coal occurs mainly in organic and inorganic forms, only a small amount of elemental sulfur sometimes being included. A substantial amount of the inorganic sulfur (pyritic sulfur) may be removed from sulfur by cleaning the coal with water and surface active agents which help to separate the coal from the heavier sulfur-containing minerals. However, these known processes result in substantially all of the organic sulfur remaining in the coal subjected to such flotation treatment, as well as a part of the pyritic sulfur also remaining therein.

SUMMARY OF THE INVENTION

Generally speaking, in accordance with the invention, pulverized coal in an aqueous slurry is subjected to flotation, for example by frothing the slurry which causes the coal to be removed in the front while a residue of pyritic sulfur remains, after which the coal from which the main portion of the pyritic sulfur has been removed is treated with dilute nitric acid, preferably at 90°-95° C. under normal pressure, which results in solubilization of the remaining pyritic sulfur and most of the organic sulfur leaving coal which has a very low sulfur content as compared to the original coal. Since the oxidation with the nitric acid does not sufficiently reduce the content of organic sulfur for all purposes for which low sulfur fuel is required, the coal is subjected to further treatment with unsaturated hydrocarbons such as olefins to bind remaining organic sulfur thereto and to thus reduce the sulfur content to the desired level.

Accordingly, it is an object of this invention to provide a method of removing sulfur from coal.

It is another object of the invention to provide a method of removing substantially all of the pyritic sulfur from coal as well as most of the organic sulfur and some elemental sulfur.

It is yet another object of the present invention to provide a method of removing sulfur by solubilizing and binding the same so that it can be easily separated from the remaining coal.

Other objects of and advantages of the invention will be apparent from a further reading of the specification and of the appended claims.

With the above and other objects in view, the present invention mainly comprises a method of removing sulfur from coal, according to which an aqueous slurry of pulverized coal is subjected to flotation, whereby coal particles are floated away and pyritic sulfur remains, and the coal particles free of a major portion of the pyritic sulfur are treated at a temperature of about 85°-95° C. at normal pressure thus solubilizing the major portion of the sulfur remaining in the coal, and subjecting the coal with its remaining content of organic sulfur to treatment with unsaturated hydrocarbons, particularly olefins, which bind remaining sulfur thereto, so that it is then possible to recover coal having a greatly reduced sulfur content.

According to the invention crushed coal is first pulverized, for example in a ball mill, to a level of about 150 mesh. The pulverized coal is mixed with water. This is conveniently done in a ratio of coal to water of about 1:10, along with 0.03-0.04% of mineral spirits or another petroleum fraction having a boiling point between about 100°-200° C. for about 5-10 minutes. When the slurry is uniformly formed, air is introduced and the resulting froth is removed into a second container. There, additional water, 0.01-0.0025 of methyl amyl alcohol or another aliphatic alcohol, and 0.1-0.3% (of the coal) of lime is added to adjust the pH to 7.5-8, along with chemicals which help to wet the coal but don't wet the mineral portions such as the pyrites.

The slurry is then mixed for about 3-5 minutes and air is introduced to form a froth, the coal being floated and removed in a series of containers. This or any other standard flotation process may be used.

The fractions of coal containing a higher level of sulfur may be subjected to an additional flotation. The flotation process permits removal of 80-90% of the pyritic sulfur. The process may be effected on a laboratory scale using the Denver Laboratory Sub-A Flotation Machine.

The coal from the flotation is filtered washed, and introduced into a reaction vessel where a dilute solution of nitric acid (preferably 4-6%) in water is slowly introduced and the mixture stirred, for example, by mechanical or magnetic means, the temperature being increased to 85°-95° C. preferably 90°-95° C.

After about ½-1 hour, the reaction is completed, the coal is filtered, washed and dried to a level of 0-8% moisture. The nitric acid has the effect of completely oxidizing the remaining pyritic sulfur which was left after the flotation process and about 35-50% of the organic sulfur, depending upon the temperature and concentration of the nitric acid.

In carrying out the process of the invention, the preferred ratio of coal to dilute nitric acid is between about 1:3-1:4. As indicated, the concentration of the nitric acid is between about 4-6%, preferably between 5-6%. The nitric acid may circulate in the system with fresh amounts of nitric acid being added to maintain the preferred concentration.

By proceeding in the above manner, the sulfur content is greatly reduced, but is not sufficiently reduced for all purposes. Further reduction of the organic sulfur content is achieved by reacting the nitric acid oxidized coal with lower sulfur content with unsaturated hydrocarbons, preferably olefins, most preferably those having a boiling temperature of 100°-250° C., although it is possible to use olefins having a boiling temperature of 50°–100° C.

The treatment of the nitric acid oxidized coal with the olefins is preferably accomplished in the presence of a catalyst which aids in the binding of sulfur to an unsaturated hydrocarbon chain, such as an olefin, the reaction being carried out at a pH of 7.5–8.5. The use of the catalyst and the pH creates conditions which promote the reaction of the olefins with the organic sulfur bound to the coal resulting in elimination of the sulfur from the coal and replacement by hydrocarbons.

Treatment with olefins cannot be accomplished until after the coal has been subjected to flotation and oxidation with nitric acid because excessively large amounts of olefins would be required, not only increasing the cost of the overall process but also making it difficult to manage the overall process.

The structure of coal is so complicated that sulfur can be present in different forms in coal molecules, depending on the type of coal. Organic sulfur is mainly included in the molecules of coal as mercaptans, aromatic, cycloaliphatic and aliphatic sulfides and disulfides, thiophens and its homologues.

In order to propose the most probable mechanism of chemical removal of organic sulfur it would be necessary to get a more detailed information about the structure of coal used for experiments especially the forms of the presence of sulfur but this has not been yet worked out sufficiently. On the basis of inclusion of sulfur in carbon ring structure it is believed that most probably the following reactions occur during the treatment with olefins:

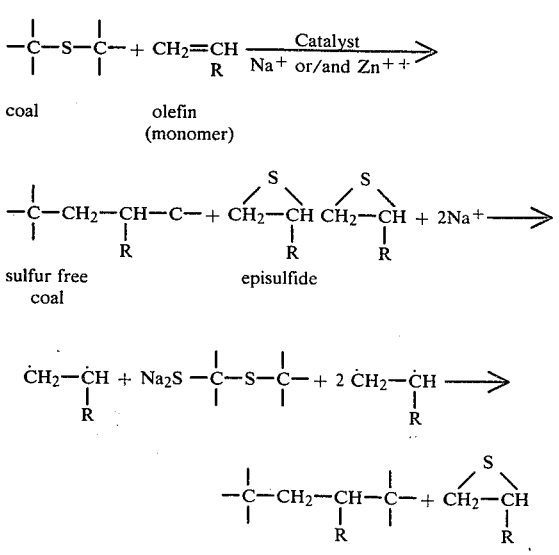

Several intermediate reactions take place, but reaction 3 is believed to be the basic one. The sodium sulfide is washed out and the subsequently dried coal can be used as a low sulfur fuel.

The treatment with olefins is effected after the oxidation process to an extent which depends on the level of reduction of sulfur content to be achieved and on the character of the organic sulfur included in the coal.

The carrying out of the process of the present invention as defined herein permits reduction in total amount of chemicals used while achieving the lowest possible sulfur content in the coal.

DESCRIPTION OF PREFERRED EMBODIMENTS

The following examples are given to further illustrate the present invention. The scope of the invention is not, however, meant to be limited to the specific details of the examples.

EXAMPLE 1

An Ohio coal 150 mesh size containing 4.29% sulfur and 3.5% moisture, supplied by North American Coal Co. was subjected to flotation in bench scale equipment manufactured by Denver Equipment Co.

200 g of coal were mixed with 2000 g water in a container. By continuous stirring 1.0 g of lime and 0.05 g of methyl amyl alcohol were introduced. After 10 min. air was introduced and the formed coal water froth directed to an empty container. When the froth started to show only traces of coal, the flotation was interrupted and the coal from the container filtered, washed and dried at 105° C. Also the residual coal was filtered and dried to obtain a full balance of the obtained fractions.

The following results were obtained:

| Coal | | Sulfur content % | Ash Content % |
|---|---|---|---|
| new without flotation | 200 g | 4.29 | 10.7% |
| flotation fraction | 176 g | 2.84 | 7.0% |
| residual fraction | 20.4 g | 15.80 | 40.0% |

EXAMPLE 2

Ohio Coal supplied by Consolidated Coal, containing 2.7% sulfur and 3% moisture, pulverized to 150 mesh by crushing under laboratory conditions and milled to over 200 mesh in a pebble mill was subjected to flotation under similar conditions to Example 1. The following products were obtained:

| | crushed 150 mesh | | | |
|---|---|---|---|---|
| Coal | yield g | sulfur content% | Ash % | yield g |
| without flotation (crude) | 200 g | 2.7% | 16.2 | 400 |
| flotation fraction | 175.0 g | 2.1 | 10.56 | 308 |
| residual fraction | 24.0 g | 4.5 | 54.10 | 88 |

| | milled over 200 mesh | |
|---|---|---|
| | sulfur content % | ash % |
| without flotation (crude) | 2.7% | 16.2 |
| flotation fraction | 1.51 | 7.6 |
| residual fraction | 4.29 | 42.0 |

EXAMPLE 3

400 g of the same milled coal as in Example 2 was subjected to flotation under similar conditions as in Example 1. Only 50% of lime was used and 2 fractions of flotation coal were taken out.

The following products were obtained:

| flotation coal | g | yield % | sulfur % | ash % |
|---|---|---|---|---|
| fraction I | 325.5 g | 80.4 | 1.6 | 7.5 |
| fraction II | 30.5 | 7.5 | 2.4 | 14.9 |
| residual | 45.5 | 11.0 | 5.9 | 66.6 |

EXAMPLE 4

A sample of flotation coal from Example 1 was used for chemical treatment for further reduction of the sulfur content by oxidation process as follows:

10 g containing 2.84% sulfur was treated at 90° C. for 30 min in a mixture of 25 g of water and 1.6 g nitric acid. A product containing 1.74% sulfur and 3.8% ash was obtained.

EXAMPLE 5

The same coal as in Example 1, without prior flotation, containing 4.3% sulfur and 10.7% ash when subjected to oxidation as in Example 4 resulted in a product containing 1.85% sulfur and 9.9% ash.

EXAMPLE 6

The first fraction of the flotation coal of Example 3, containing 1.6% sulfur and 7.6% ash was treated with dilute nitric acid as in Example 4. A product containing 0.89% sulfur and 3.85% ash was obtained. cl EXAMPLE 7

A flotation sample, as in Example 1, of Pittsburgh No. 8 coal containing 2.96% sulfur was subjected to chemical treatment with unsaturated hydrocarbons (olefins) for reduction of sulfur content as follows:

20 g coal
5 g cyclooctadiene
0.3 g BPO (10% solution in xylene)
3 g $Zn(NO_3)_2$ $6H_2O$
20 g butanol The above were mixed and stirred at 150° C. at normal pressure for 2 hours. Then the product was filtered and washed with water. A product containing 1.65% sulfur was obtained.

EXAMPLE 8

The same flotation coal as in Example 7 was treated under the following conditions:

20 g coal
2 g - dodecene-1
2 g isopropanol
0.2 g BPO
5 g NaOH+10 g NaOH

The above were mixed at 100° C. and normal pressure for 4 hours and then filtered and washed with water. A product containing 1.36% sulfur was obtained.

EXAMPLE 9

Milled and flotation coal as in Example 3, containing 1.74% sulfur was treated with olefins as follows:

20 g coal
1.4 g dodecene-1
1.5 g of 10% BPO solution in MEK
1.0 g NaOH+8 g water The above were mixed for 18 hours at normal pressure and 100° C. then filtered and washed. A product containing 0.93% sulfur was obtained.

EXAMPLE 10

A sample of coal prepared as in Example 3 containing 1.55% sulfur was subjected to oxidation as in Example 4 and a product containing 0.89% sulfur was obtained. Then the coal was treated with olefins as follows:

20 g coal
6 g dodecene-1
0.25 g of 10% BPO Solution in xylene
1 g NaOH+9 g water The reaction was run at 20 psi and 125° C. for 2 hours, then the coal was filtered, washed with water in the beginning at pH-6, and then with normal water. A product containing 0.69% sulfur was obtained. When the reaction was performed at normal pressure and all other conditions were the same, a coal containing 0.78% sulfur was obtained.

EXAMPLE 11

A sample of Pittsburgh coal, subjected to flotation as in Example 1, containing 3.2% sulfur was subjected to oxidation by dilute nitric acid as in Example 4 and then to olefin treatment as follows:

20 g coal
4 g hexadecene-1
2 g isopropanol
0.2 g BPO in a 10% solution of MEK
4 g NaOH+16 g water The reaction was ran for 4 hours at 125° C. and 15 psi then the coal was filtered and washed as in Example 10.

The following results were obtained:

| % Sulfur Content | | |
|---|---|---|
| Initial | After Oxidation | After Olefin Treatment |
| 3.2 | 1.9 | 1.37 |

While the invention has been discussed in particular with respect to specific examples, it is apparent that variations and modifications can be made without departing from the spirit or scope of the invention.

What is claimed is:

1. Method of removing organic sulfur from coal from which the main portion of pyritic sulfur has been removed by froth flotation but which still contains sulfur mainly in the form of organic sulfur and to some extent in the form of pyritic sulfur, which comprises treating such coal containing said organic sulfur with dilute nitric acid, thereby oxidizing any remaining pyritic sulfur and also oxidizing organic sulfur, thereby solubilizing the pyritic sulfur and a substantial portion of the organic sulfur, filtering and washing the thus treated coal, thereby removing the solubilized sulfur and nitric acid therefrom, and treating the thus obtained coal still containing organic sulfur with an unsaturated hydrocarbon which binds remaining organic sulfur thereto thus removing the same from the coal, thereby obtaining substantially completely desulfurized coal.

2. Method according to claim 1 wherein the nitric acid treatment is effected at a temperature of about 85°-95° C.

3. Method according to claim 2 wherein the nitric acid treatment is effected under normal pressure.

4. Method according to claim 3 wherein the nitric acid concentration is about 4-6%.

5. Method according to claim 4 wherein the ratio of coal to dilute nitric acid is between about 1:3 and 1:4.

6. Method according to claim 1 wherein said unsaturated hydrocarbon is an olefin.

7. Method according to claim 1 wherein said unsaturated hydrocarbon is selected from the group consisting of thermocracking gasoline, cocker gasoline, alpha olefins and cycloaliphatic olefins.

8. Method according to claim 1 wherein the treatment with the unsaturated hydrocarbon of the coal still containing organic sulfur is effected at a temperature of 100°-200° C. and a pressure of 0-50 psi.

9. Method according to claim 1 wherein the treatment with the unsaturarted hydrocarbon of the coal still containing organic sulfur is effected in the presence of a peroxide catalyst.

10. Method according to claim 1 wherein the treatment with the unsaturated hydrocarbon of the coal still containing organic sulfur is effected in the presence of an accelerator selected from the group consisting of zinc nitrate, sodium carbonate and sodium hydroxide.

* * * * *